US006971913B1

(12) United States Patent
Chu

(10) Patent No.: US 6,971,913 B1
(45) Date of Patent: Dec. 6, 2005

(54) MICRO COAXIAL CONNECTOR

(75) Inventor: Chang-Hsing Chu, Taipei (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/880,496

(22) Filed: Jul. 1, 2004

(51) Int. Cl.[7] ..... H01R 9/05
(52) U.S. Cl. ..... 439/582; 439/63; 439/581; 439/585
(58) Field of Search ..... 439/63, 581, 582, 439/585, 944

(56) References Cited

U.S. PATENT DOCUMENTS 5,772,470 A * 6/1998 Togashi ..... 439/582
6,508,668 B1 * 1/2003 Yamane ..... 439/582
6,739,907 B2 * 5/2004 Kuroda et al. ..... 439/582
6,916,201 B1 * 7/2005 Chu ..... 439/582

* cited by examiner

*Primary Examiner*—Ross Gushi
(74) *Attorney, Agent, or Firm*—Troxell Law Office, PLLC

(57) ABSTRACT

The micro coaxial connector includes a signal terminal, a main body, and two grounding elements. The signal terminal has a pair of tag-like contact arms and bending arms at a front and rear end thereof, and a strip plane at a middle section thereof. The contact arms are for contacting with a base of a printed circuit board (PCB). The main body is for receiving the signal terminal and serving as an insulation. The two grounding elements are separated designs. The cylindrical-shaped first grounding element is for receiving and fastening the main body, and has a pair of extension arms for providing the coaxial cable with suitable clamping forces. The second grounding element is a cover-like body, and has a strip-like projection for increasing strength against bending of the second grounding element and preventing loosening of components.

5 Claims, 4 Drawing Sheets

MICRO COAXIAL CONNECTOR

BACKGROUND OF THE INVENTION (a) Field of the Invention

The invention relates to a micro coaxial connector, and more particularly, to a micro coaxial connector having elevated quality yielding rate and production output as well as enhanced electrical characteristics, thereby uplifting economical values thereof.

(b) Description of the Prior Art

The invention provides an advanced micro coaxial connector in connection with the U.S. Pat. No. 6,508,668B1, and 6,503,100B2.

Referring to the U.S. Pat. No. 6,508,668B1, and 6,503,100B2, and FIG. 1, the prior invention comprises terminals 10, a dielectric block 20 and an outer conductor 30. The terminals 10 are U-shaped bodies, and are made from metal strips so as to be coupled with a carrier 11 at regular intervals. Each terminal 10 has a connection section 12 and a contact section 13. A front end of each terminal 10 has a separated line 14 for pressing against a cover section 22 of the dielectric block 20. A rear end of the each terminal 10 has a pair of erect walls 15, and the erect walls 15 have a notch 15A in between for receiving a central conductor B1 at a front end of a coaxial cable B. The central conductor B1 of a cable B is soldered to the connection section 12 of the terminal 10. The soldered terminal 10 is placed into the cylindrical body section 21 of the dielectric body 20, which is then accommodated in an accommodating chamber 311 of a cylindrical section 31 of the outer conductor 30. Each end of the cylindrical section 31 and an outer cover section 32 is connected with a perpendicular enclosure section 33, such that the cylindrical section 31 and the outer cover section 32 are perpendicular to the enclosure section 33. After completing the above assembly, using precision apparatus, the outer cover section 32 is bent toward the cylindrical section 31. A front arm 321, a middle arm 322 and a rear arm 323 provided at two sides of the cylindrical section 32 are bent and fastened to the cylindrical section 31 and the coaxial cable B.

The inventions disclosed by U.S. Pat. Nos. 6,508,668B1, and 6,503,100B2 are indeed capable of accomplishing coaxial connectors. However, structures of these prior inventions yet have the following shortcomings.

1. In the two prior U.S. patents, the terminals are connected to the coaxial cable by means of soldering. However, soldering is likely to leave behind residual objects such as tin dregs, which further affect performances of electrical characteristics of products. In addition, manual soldering is not only time-consuming but also labor-intensive, and production output is limited with instable quality.

2. In manufacturing process of the aforesaid outer cover section and cylindrical section, 90-degree bending is required. Supposed precision apparatus are not available for the bending and positioning process, defective rate of products is inevitably elevated with increased production cost, and thus again affecting production output.

SUMMARY OF THE INVENTION

It is an object of the invention to provide a micro coaxial connector having a design of a pair of tag-shaped bending arms downwardly extended at two sides of a signal terminal thereof, respectively, wherein the bending arms clamp each end to fasten a coaxial cable, so as to prevent unidentified residual objects such as tin dregs from soldering that further affect quality of products, thereby shortening time for manufacturing and elevating production output.

It is another object of the invention to provide a micro coaxial connector having designs of a pressing tag at a front end of a main body, a dented carrier portion at an appropriate position, and a receiving portion, so as to exactly accommodate the signal terminal in the main body.

It is another object of the invention to provide a micro coaxial connector having a design of two separated grounding elements, so as to eliminate accurate 90-degree bending and positioning of the grounding elements that are achieved by using precision apparatus during manufacturing process, thereby avoiding a drawback of having relatively higher defective rate in manufacturing coaxial connectors.

The present invention comprises a signal terminal, a main body and two grounding elements. The signal terminal is long and thin in shape; and has a pair of downwardly extended contact arms and bending arms at two ends thereof, respectively, and a strip portion at a middle section thereof. The strip portion is held at a dented carrier portion located at an appropriate position of the main body. The contact arms are placed in a hollow portion vertically penetrated at a front portion of the main body, and serve as resilient arms contacting with a base of a printed circuit board (PCB). The bending arms for clamping and fastening a coaxial cable are received at a dented receiving portion located at a rear end of the main body that serves as an insulation between the signal terminal and the two grounding elements. The main body has a vertically disposed pressing tag at a front end thereof, and the pressing tag has a size corresponding to the receiving portion at the rear end to be pressed against. The two grounding elements are separated designs. The first grounding element is a cylindrical body for receiving and accommodating the main body, and has a pair of extension arms at two sides thereof, respectively, so as to provide the coaxial cable with suitable clamping forces. The second grounding element is a cover-shaped body having a strip-like projection at an appropriate position thereof for increasing strength against force that may cause the second grounding element to bend and avoiding the disassembly of the components. The second grounding element also has bending arms at a front end and two sides thereof for preventing electromagnetic interference (EMI) and serving as planes for applying force when the connectors are pulled out by tools. The second grounding element further has a pair of large bending arms and a pair of rear bending arms at a rear end thereof for pressing and clamping the first ground element and the coaxial cable, respectively.

DETAILED DESCRIPTION OF THE PREFERRED EMBODIMENTS

These and other objects of the present invention will become apparent from a reading of the following specification, taken in conjunction with the enclosed drawings.

Figure 1:
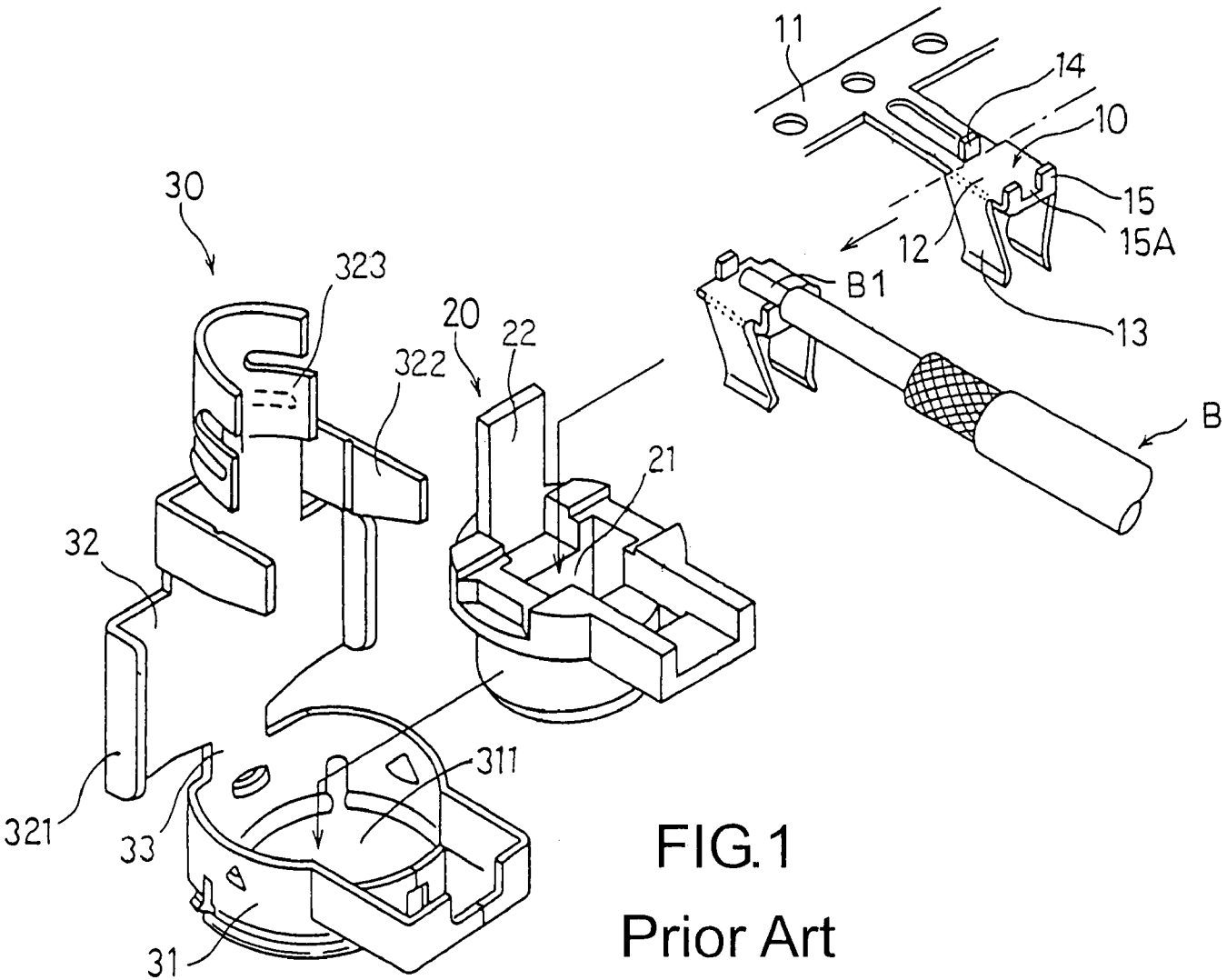
FIG.1 Prior Art
FIG. 1 shows an exploded elevational view of the U.S. Pat. No. 6,508,668B1, and 6,503,100B2.
Figure 2:
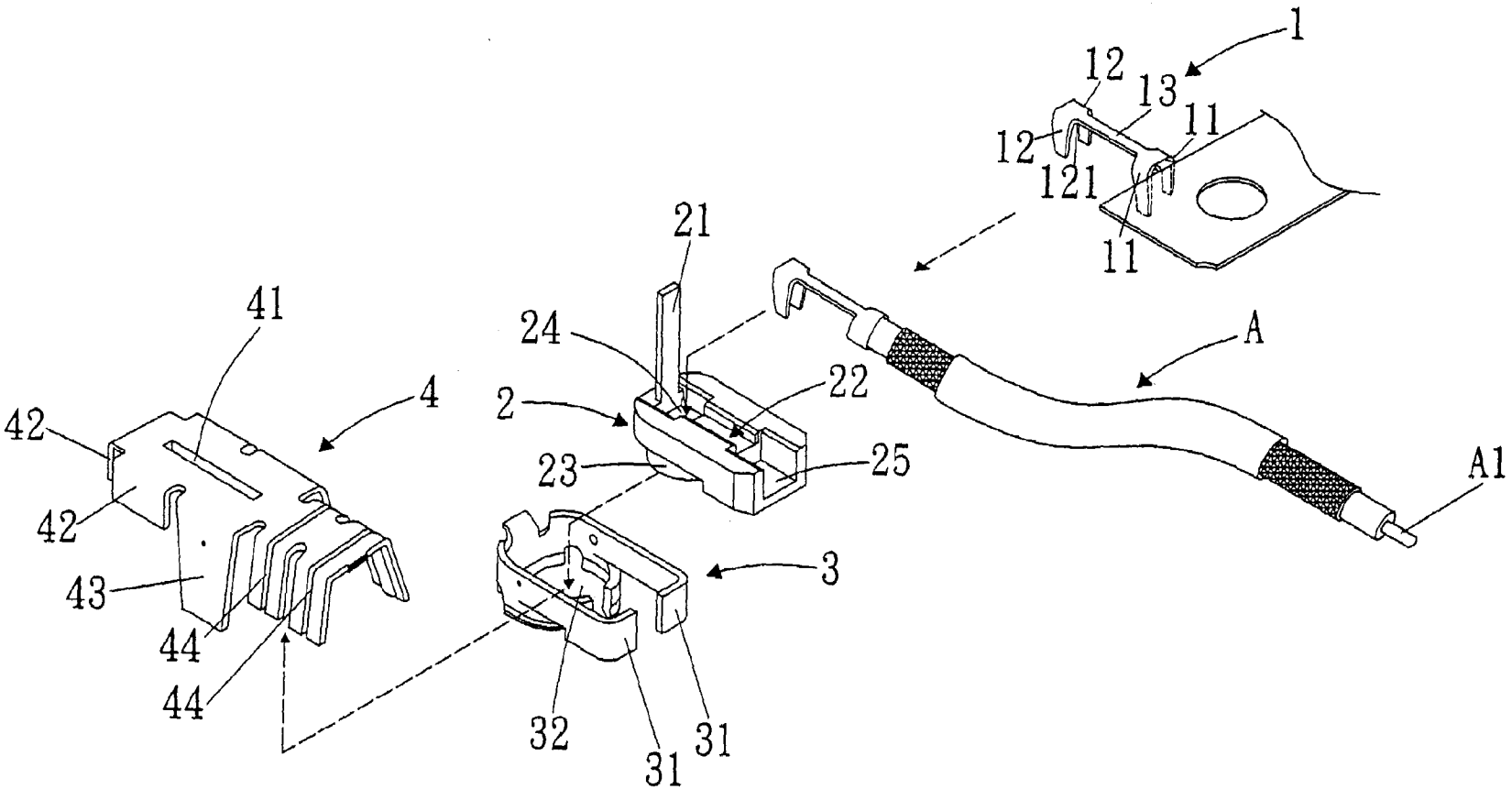
FIG. 2 shows an exploded elevational view according to the invention.

Referring to FIG. 2 showing an exploded elevational view according to the invention, the invention comprises:

a signal terminal 1 being long and thin in shape; and formed with a pair of downwardly extended contact arms 12 and bending arms 11 at front and rear ends thereof, respectively, and a strip portion 13 at a middle section therebetween; wherein:

the contact arms 12 are for contacting with a base of a printed circuit board (PCB), and the two bending arms 11 are formed with a clamping aperture 111 in between for accommodating a central conductor A1 of a coaxial cable A as well as clamp and position the coaxial cable A;

a main body 2 made of an electrically insulating material has a cylindrical protruding portion 23 at a front portion thereof, a pressing tag 21 at a front end thereof, a dented carrier portion 22 at an appropriate position thereof for holding the strip portion 13 of the signal terminal 1 and corresponding with the signal terminal 1, a hollow portion 24 vertically penetrated at a front portion thereof for placing the contact arms 12 of the signal terminal 1, and a dented receiving portion 25 at a rear end thereof for receiving the bending arms 11 to be bent toward the coaxial cable A, and serves as an insulation between the signal terminal 1 and two grounding elements 3 and 4;

two grounding elements 3 and 4 as separated designs; wherein:

the grounding element 3 is cylindrical in shape; and has a recess 32 at an appropriate position thereof for placing the protruding portion 23 of the main body 2 as well as receiving and fastening the main body 2, a pair of extending arms 31 at two sides thereof for providing the coaxial cable A with suitable clamping forces, such that the main body 2 is not likely to disengage from the signal terminal 1 and the coaxial cable A when placed within the first grounding element 3 for further facilitating assembly thereof;

the second grounding element 4 is a cover-shaped body; and has a strip-like projection 41 at an appropriate position thereof for increasing strength against the force that may cause the second grounding element 4 to bend and avoiding disassembly of the components, a pair of bending arms 42 at a front end and two sides thereof for preventing electromagnetic interference (EMI) and serving as planes for applying force when the connectors are pulled out by tools, a pair of large bending arms 43 and a pair of rear bending arms 44 at a rear end thereof for pressing the first grounding element 3 and the coaxial cable A, respectively.

Using an assembled structure as described above, a micro coaxial connector is provided with elevated quality yielding rate and production output as well as enhanced electrical characteristics, thereby uplifting economical values thereof.

Figure 3:
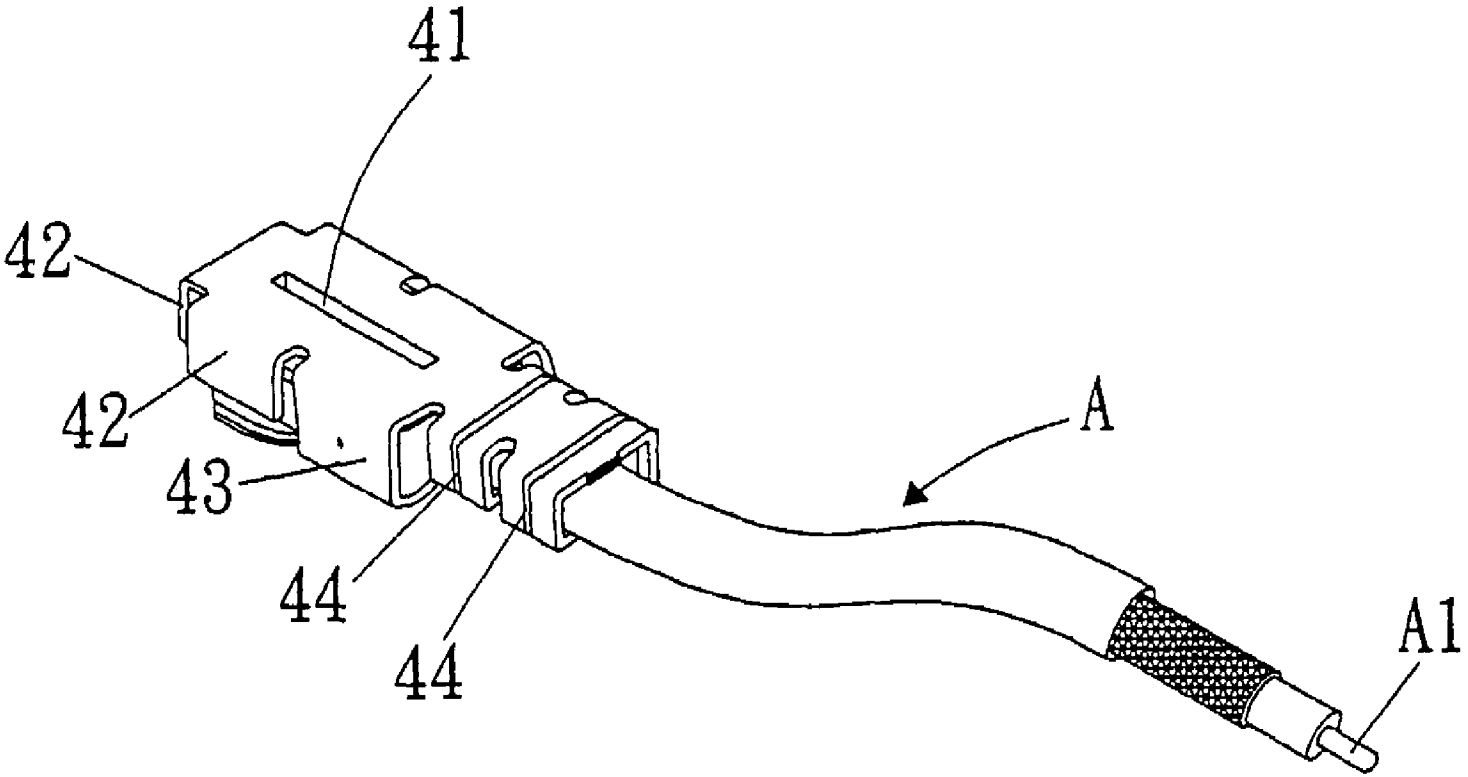
FIG. 3 shows an elevational view according to the invention.
Figure 4:
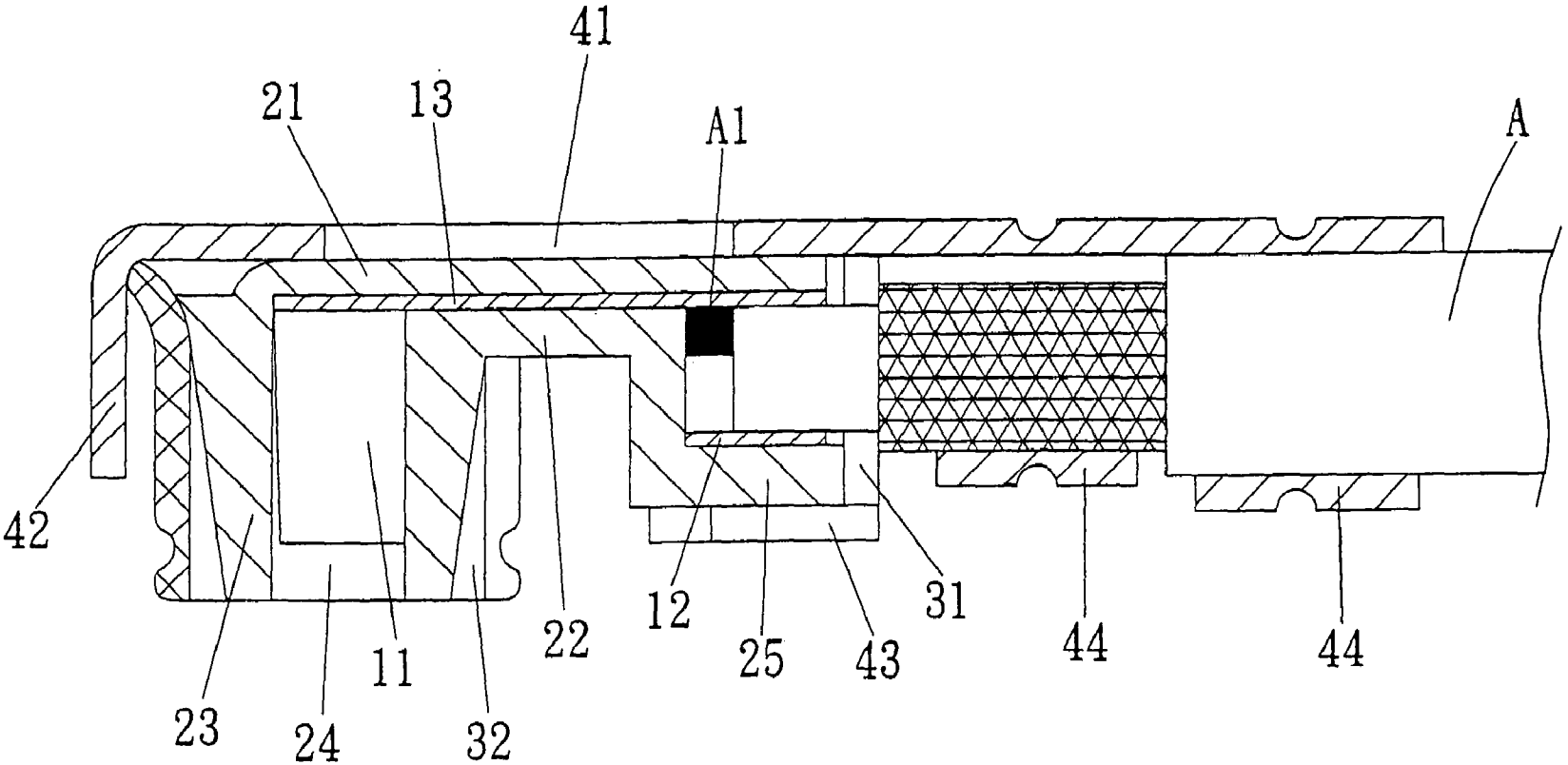
FIG. 4 shows a side sectional schematic view according to the invention.

Referring to FIGS. 3 and 4, assembly of the invention is realized by using the following principles. The central conductor A1 of the coaxial cable A is placed into the clamping aperture 111 between the bending arms 11 of the signal terminal 1, and the bending arms 11 are simultaneously bent inward so as to clamp and fasten the coaxial cable A. The signal terminal 1 is accommodated in the hollow portion 24 of the main body 2, and the contact arms 12 of the signal terminal 1 are also placed in the hollow portion 24 of the main body 2. The strip portion 13 of the signal terminal 1 is placed on the carrier portion 22 of the main body 2, and is held by the carrier portion 22. The bending arms 11 clamping and fastening the coaxial cable A are exactly received by the dented receiving portion 25 at the rear end of the main body 2. The vertical pressing tag 21 at the front end of the main body 2 is bent and pressed toward the carrier portion 22, and the main body 2 is accommodated in the first grounding element 3, then the protruding portion 23 of the main body 2. is received in the recess 32 of the first grounding element 3. The coaxial cable A is provided with appropriate clamping forces by the two extending arms 31 at the two sides of the first grounding element 3, such that the main body 2, the signal terminal 1 and the coaxial cable A placed in the first grounding element 3 are not likely to disengage for further facilitating assembly. The second grounding element 4 is covered onto the first grounding element 3. Using a common apparatus, the three bending arms 42 at the front end and sides, and the large bending arms 43 at the rear end of the second grounding element 4 are bent for clamping the first grounding element 3. The rear bending arms 44 are bent for clamping the coaxial cable A.

According to the structure described above, the invention has the following excellences:

1. Through a design of a pair of tag-shaped bending arms extending from two sides of the signal terminal, respectively, the bending arms at each end clamp the coaxial cable, thereby preventing unidentified residual objects such as tin dregs from soldering that further affect quality of products, and thus enhancing electrical characteristics of electric appliances.

2. Through a separated design of the two grounding elements, the complicated manufacturing processes of accurate 90-degree bending and positioning of the grounding elements that are achieved by using precision apparatus are eliminated during manufacturing processes, thereby avoiding a drawback of having relatively higher defective rate in manufacturing coaxial connectors.

Conclusive from the above, the micro coaxial connector according to the invention provides novel structures for the signal terminal, main body and the two grounding elements. The invention is capable of elevating quality yielding rate and production output of products, and shortening time required for production. Therefore, the invention indeed overcomes the drawbacks and inconveniences of the prior U.S. patents, and hence offers economical values.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A micro coaxial connector for elevating quality yielding rate, enhancing electrical characteristics and increasing economical values, comprising:

a signal terminal being long and thin in shape; and having a pair of downwardly extended contact arms and bending arms at front and rear ends thereof, respectively, and a strip portion at a middle section thereof; wherein:

the contact arm for contacting with a base of a printed circuit board (PCB), and the two bending arms formed with a clamping aperture in between;

a main body having a cylindrical protruding portion at a front portion thereof, a pressing tag at a front end thereof, a dented carrier portion at an appropriate position thereof for correspondingly holding the strip portion of the signal terminal, a hollow portion vertically penetrated at a front portion thereof for placing the contact arms of the signal terminal, and a dented receiving portion at a rear end thereof for receiving the bending arms;

two grounding elements as separated designs; wherein:

a first grounding element is cylindrical in shape; and has a recess at an appropriate position thereof for placing the protruding portion of the main body as well as receiving and fastening the main body, and a pair of extending arms at two sides thereof for providing the coaxial cable with suitable clamping forces; and a second grounding element is a cover-shaped body; and has a strip-like projection at an appropriate position thereof for increasing strength against bending of the grounding element and avoiding disassembly thereof;

wherein the second grounding element has bending arms at a front end and two sides thereof, thereby preventing electromagnetic interference (EM) and serving as planes for applying force when the connector are pulled out by tools.

2. A micro coaxial connector for a coaxial cable comprising:

a) a signal terminal having:

i) a strip portion;

ii) two contact arms located on a first end of the strip portion and selectively engaging a base of a printed circuit board; and iii) two bending arms located on a second end of the strip portion and having a clamping aperture, a central conductor of the coaxial cable is inserted into the clamping aperture and connected to the signal terminal by the two bending arms;

b) a main body having:

i) a pressing tag located on a first end thereof;

ii) a cylindrical protruding portion on the first end thereof adjacent to the pressing tag, and having the contact arms inserted therein;

iii) a dented receiving portion located on a second end thereof and having the two bending arms inserted therein; and iv) a dented carrier portion located between the cylindrical protruding portion and the dented receiving portion, and having the strip portion inserted therein, the pressing tag covering a top of each of the strip portion, the two contact arms, and the two bending arms;

c) a first grounding element being a cylindrical shape and having:

i) a recess having the cylindrical protruding portion inserted therein; and ii) two extending arms extending around the second end of the main body and engaging the coaxial cable; and d) a second grounding element connected to the first grounding element with the main body located there between and having a grounding element strip portion located above the pressing tag.

3. The micro coaxial connector according to claim 2, wherein the second grounding element includes three first bending arms located on a first end and two opposing sides thereof, each of the three first bending arms overlapping a side of the first grounding element.

4. The micro coaxial connector according to claim 2, wherein the second grounding element includes two second bending arms extending around a bottom of the first grounding element.

5. The micro coaxial connector according to claim 2, wherein the second grounding element includes two pairs of third bending arms connecting the second grounding element to the coaxial cable.

* * * * *